US005743195A

United States Patent [19]

Sucharski

[11] Patent Number: 5,743,195

[45] Date of Patent: Apr. 28, 1998

[54] APPARATUS FOR THE VENTILATION, FILTRATION AND COLLECTION OF CREMATED REMAINS DUST PRODUCED DURING PROCESSING

[76] Inventor: William E. Sucharski, 14003 Erwin St., Philadelphia, Pa. 19116

[21] Appl. No.: 797,848

[22] Filed: Feb. 10, 1997

[51] Int. Cl.[6] ..... F23G 1/00; B02C 9/04

[52] U.S. Cl. ..... 110/194; 110/165 R; 241/77

[58] Field of Search ..... 110/194, 189, 110/193, 345, 165 R; 241/77; 55/467, 471, 472, 385.1, 385.2, 385.5

[56] References Cited

U.S. PATENT DOCUMENTS

| | | | |
|---|---|---|---|
| 3,284,148 | 11/1966 | Ramniceanu | 312/209 |
| 3,770,215 | 11/1973 | Wittke | 241/77 |
| 3,812,370 | 5/1974 | LaViolette | 250/527 |
| 3,837,301 | 9/1974 | Falling | 110/194 |
| 4,473,012 | 9/1984 | Duran | 110/194 |
| 4,603,644 | 8/1986 | Brookes | 110/194 |
| 4,955,548 | 9/1990 | Rahill | 110/194 |
| 5,014,630 | 5/1991 | Looker | 110/194 |
| 5,317,978 | 6/1994 | Alexandersson | 110/194 |
| 5,435,837 | 7/1995 | Lewis et al. | 96/54 |

*Primary Examiner*—Ira S. Lazarus
*Assistant Examiner*—Nhat-Hang H. Lam
*Attorney, Agent, or Firm*—Patent & Trademark Services; Joseph H. McGlynn

[57] ABSTRACT

A stand which will hold an apparatus for comminuting cremation remains. The stand includes a support for the comminuting apparatus and built in vents which communicate with a blower motor to draw in all of the resulting dust and other contaminants resulting from this process. A series of filters are placed in communication with the vents to trap all pollutants.

8 Claims, 1 Drawing Sheet

FIG. 1
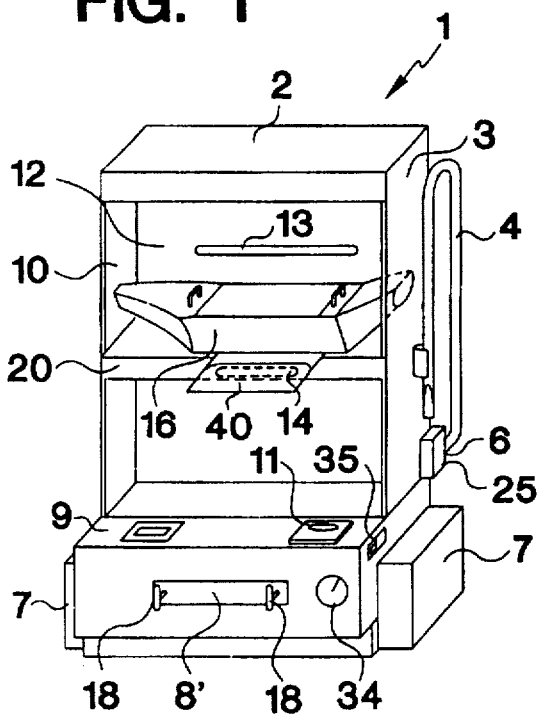
FIG. 2
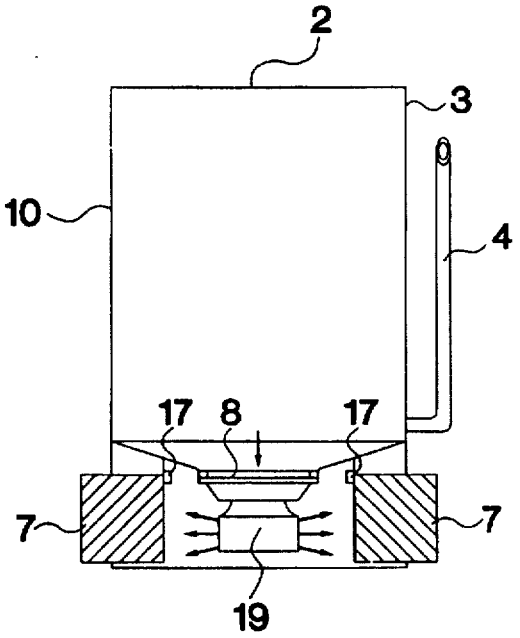
FIG. 3
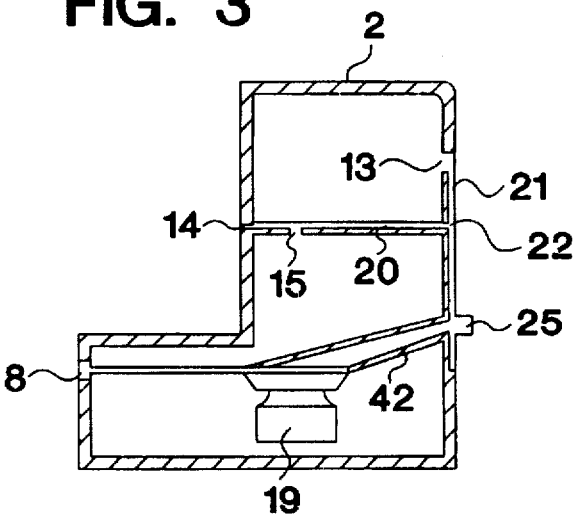
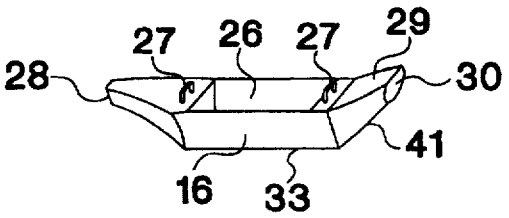
FIG. 4

APPARATUS FOR THE VENTILATION, FILTRATION AND COLLECTION OF CREMATED REMAINS DUST PRODUCED DURING PROCESSING

BACKGROUND OF THE INVENTION

This invention relates, in general, to a stand for use in the final processing of cremated remains, and, in particular, to a stand which incorporates ventilators and filters that arrest any volatile material that becomes airborne during handling.

DESCRIPTION OF THE PRIOR ART

In the prior art various types of cremation related devices have been proposed. For example, U.S. Pat. No. 3,837,301 discloses a grinding apparatus for pulverizing cremated remains for disposition to an urn.

U.S. Pat. No. 4,473,012 discloses a suction type apparatus which removes the remains from a crematory furnace and which grinds the fragments into fine particles, and which has filters which collect fine particles from the vacuum line.

U.S. Pat. No. 4,603,644 discloses a cremation chamber wherein reduction burning takes place in a coffin chamber and oxidation burning in a separate chamber, allowing two bodies to be processed at a time.

U.S. Pat. No. 4,955,548 discloses an apparatus for comminuting cremation remains which has a processing drum with a rotating comminuting blade driven by a shaft. An ash pan is rotatably positioned so as to move into and out of engagement with the drum for charging the drum with cremated remains for further comminution.

U.S. Pat. No. 5,014,630 discloses a cremator with a serpentine pathway for gases that maintains the heat level for a greater period of time, and in essence reclaims wasted heat.

U.S. Pat. No. 5,317,978 discloses an incinerator with two sources of heat and a blower to blow opposite the direction of fumes and gases to force the efficient final burnout of combustion fumes.

While various types of cremation related devices have been proposed, none of the prior art devices fully takes into consideration the entire process of disposing of cremated remains, including the grinding process and the handling of the resulting dust and other contaminants resulting from this process.

SUMMARY OF THE INVENTION

The present invention comprises a stand which will hold an apparatus for comminuting cremation remains such as the apparatus disclosed in U.S. Pat. No. 4,955,548, which is hereby incorporated in its entirety by reference. The stand includes a support for the comminuting apparatus and built in vents which communicate with a motor to draw in all of the resulting dust and other contaminants resulting from this process. A series of filters are placed in communication with the vents to trap all pollutants.

It is an object of the present invention to provide an improved stand for assisting in the comminuting or cremated remains.

It is an object of the present invention to provide an improved stand for assisting in the comminuting or cremated remains which will filter the resulting dust and other contaminants resulting from this process.

These and other objects and advantages of the present invention will be fully apparent from the following description, when taken in connection with the annexed drawings.

BRIEF DESCRIPTION OF THE DRAWINGS

FIG. 1 is a perspective view of the present invention.

FIG. 2 is a a partial cut away view of the present invention.

FIG. 3 is a cross-section view of the present invention.

FIG. 4 is a perspective view of a transfer tray used with the present invention.

DESCRIPTION OF THE PREFERRED EMBODIMENT

Referring now to the drawings in greater detail, FIG. 1 shows the stand 1 of the present invention which comprises a bottom, back, sides 3, 10, and a top 2. The stand consists of a free standing enclosure having a bottom shelf 9 on which a grinding apparatus, such as the apparatus disclosed in U.S. Pat. No. 4,955,548, will rest. On the underside of the top shelf 20 is positioned at least one air vent 15 which will be connected to a blower motor 19 and which will collect dust and other airborne contaminants which will result from the operation of transferring cremated remains from the processing tray 16 and placing non-combustible materials into a collection bucket (not shown).

Above the bottom shelf 9 is a second shelf 20 which will support a tray 16, which will be used for a purpose to be described later. The second shelf 20 has another air vent 14 which will be connected to the blower motor 19 to collect contaminants which result from the transfer into, and the use of the comminuting apparatus. Air vent 14 can have a semi-circular, arced extension 40 which will help to guide the contaminants into the air vent 14. A third air vent 13 is positioned on the back wall of the stand, behind the second shelf 20, which is connected to the blower motor 19 to collect contaminants which can be produced when transferring remains into the tray 16 and when inspecting the remains in the tray.

On the bottom shelf of the stand 1 is mounted a magnet 11 which will be used to "sift" the comminuted remains to remove any metallic objects which might remain after the comminuting process. The magnet 11 could be positioned in any location on the stand where it will be readily available for use, and its location should not be limited to any specific location.

It should be noted that while the stand 1 is shown as a basically rectangular structure, this is merely for illustration purposes. The stand can assume any shape, which will incorporate the various accessories such as the shelves, vents, filters, etc., without departing from the scope of the invention. In addition, the stand could be made as an integral unit, or it could be made as separate elements which can be readily assembled or disassembled.

As shown in FIG. 2, a conventional industrial blower motor 19 is mounted into the bottom of the stand 11. The arrows show the direction of air flow into and out of the blower motor 19. The blower motor is connected by means of an open space within the lower compartment to a pair of HEPA filters 7, which are located downstream of the blower motor and which are designed to filter up to 99.99% of the particles as small as 0.3 microns. The preferred filters 8 are 30/30 filters made by FARR, Inc. and measure 15"×20"×1". The preferred filters 7 are Hi-Flow HEPA filters also made by FARR, Inc., and measure 12"×24"×12". It should be understood that other filters can be used provided they perform in the intended manner.

As shown in FIG. 3, the blower motor 19 is also connected to a third pre-filter 8 positioned directly above the blower motor and upstream of the motor (see also FIG. 1). The filter 8 is mounted in a drawer 8', with any conventional type of latches 18, to make a tightly sealed filtration chamber and to make changing and/or cleaning the filter easier.

On the side 3, a conventional booster vacuum motor 25 is mounted and a vacuum hose 4 is attached which is connected to the air ducts leading to the blower motor 19. The vacuum hose can be used to collect fallen or settled debris or debris that has escaped from the area inside the stand. The booster motor 25 is mounted outside the main duct to increase the pressure of the air flow within the hose. Also, mounted on the face or front of the stand is a conventional air pressure gauge 34 to monitor air pressure in the system. If the pressure drops, it signifies that the filters are clogged and the efficiency of the system is decreasing, thus requiring cleaning or replacing of the pre-filter. An on/off switch 35 could also be mounted on the side of the stand.

In addition, as shown in FIG. 2, conventional safety interlock switches 17 could be mounted adjacent the filters 7, 8 which would cut off power to the system if the filters are removed while the system is running.

FIG. 3 is a cross-sectional view of the stand showing the location of the vents 13, 14, 15 and the open space in the back wall of the stand and the passageway 42 connecting these vents to the blower motor 19. It should be noted that locating the ducts in the back wall 22 is merely one option. The ducts could also be located in the side walls 3, 10 if so desired.

FIG. 4 shows an enlarged, perspective view of the collecting tray used with the present invention. The tray has ends 28, 30, with the ends being open to allow transfer of material from the compartment 26 to an urn and/or the processing drum (both not shown). Sides 16, an open compartment 26, and a bottom 33 complete the tray. The open end 28 is smaller than the open end 30 in order to use the end 30 to transfer the remains into the processing drum. The open end 28 is smaller to make it easier to transfer the processsd remains from the tray to an urn, as will be explained below. The tray also has a pair of handles 27 which will make handling the tray easier. The end 30 has an upwardly sloping top 29 and a bottom 41 which will contain the remains in the compartment 26 until they are emptied from the tray.

In use, a comminuting apparatus, such as the one disclosed by U.S. Pat. No. 4,955,548, would be installed on the shelf 9. The blower motor 19 would be turned on. The cremated remains, collected from the cremation chamber, would be transferred into the processing tray open chamber 26, where the operator would visually inspect the remains and also sift the remains with the magnet 11 to remove any non-combustible materials. Then the operator would pour the unprocessed, cremated remains through the larger opening 30 into the processing or comminuting apparatus drum. Then the cremated remains would be processed (comminuted) in the comminuting apparatus The air vents 13, 14, 15 would pull in any air borne contaminants resulting from the transferring, inspection and comminuting process. The air would be pulled through the ducts in the back wall 32 and passed through the filters 7, 8. After the comminuting of the remains is complete, the remains would be transferred again to the compartment 26 in the processing tray where they could be visually and magnetically inspected a second time to remove any non-combustible, foreign particles. The tray could then be used to transfer the remains to an urn, or other container, by holding the tray by the handles and pouring the remains through the smaller open end 28.

Although the Apparatus for the Ventilation, Filtration and Collection of Cremated Remains Dust Produced During Processing and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

What I claim as my invention is:

1. An apparatus for the ventilation, filtration and collection of cremated remains dust comprising:

a stand having a top, bottom, back and sides, said stand having at least two shelves positioned between said top and bottom, one of said at least two shelves adapted to hold a comminuting apparatus, vent means on at least said back wall and on one of said at least two shelves for collecting debris produced by said comminuting apparatus, means for pulling air through said vent means, duct means for connecting said vent means to said means for pulling air through said vent means.

2. The apparatus for the ventilation, filtration and collection of cremated remains dust as claimed in claim 1, wherein said stand has a vacuum hose mounted thereon, said vacuum hose connected to said means for pulling air through said vent means.

3. The apparatus for the ventilation, filtration and collection of cremated remains dust as claimed in claim 1, wherein said stand has an air gauge means mounted thereon for detecting a diminution in the air passing through said duct means.

4. The apparatus for the ventilation, filtration and collection of cremated remains dust as claimed in claim 1, wherein said duct means has at least one filter means detachably mounted thereto for trapping contaminants passing through said duct means.

5. The apparatus for the ventilation, filtration and collection of cremated remains dust as claimed in claim 4, wherein a safety interlock means is attached to said stand for interrupting electrical power to said means for pulling air through said vent means if said filter means is removed.

6. The apparatus for the ventilation, filtration and collection of cremated remains dust as claimed in claim 1, in combination with a collecting means for collecting the remains from said comminuting apparatus, said collecting means having a compartment for visually and magnetically purifying said remains and at least one open end for transferring said remains to a container.

7. The apparatus for the ventilation, filtration and collection of cremated remains dust as claimed in claim 6, wherein said collecting means is a container, said container having a bottom, sides, ends and a partially open top, said ends each having an opening which is smaller than said partially open top, whereby remains can be collected in said partially open top and transferred by said openings in said ends to a storage container.

8. The apparatus for the ventilation, filtration and collection of cremated remains dust as claimed in claim 1, in combination with a magnet means for removing metallic items from said debris produced by said comminuting apparatus.

* * * * *